US009857064B1

(12) United States Patent
Hung

(10) Patent No.: US 9,857,064 B1
(45) Date of Patent: Jan. 2, 2018

(54) LIGHT WITH RETRACTABLE SLEEVE

(71) Applicant: YONGGUAN ELECTRONIC TECHNOLOGY(D.G.) LTD, Dongguan (CN)

(72) Inventor: Chi Kang Hung, Dongguan (CN)

(73) Assignee: YONGGUAN ELECTRONIC TECHNOLOGY (D.G.) LTD, Dongguan (CN)

( * ) Notice: Subject to any disclaimer, the term of this patent is extended or adjusted under 35 U.S.C. 154(b) by 5 days.

(21) Appl. No.: 15/187,673

(22) Filed: Jun. 20, 2016

(51) Int. Cl.

| | |
|---|---|
| ***F21V 19/02*** | (2006.01) |
| ***F21V 11/08*** | (2006.01) |
| ***F21V 23/04*** | (2006.01) |
| ***F21S 8/02*** | (2006.01) |
| ***F21V 17/16*** | (2006.01) |
| ***F21V 17/12*** | (2006.01) |
| ***F21K 9/237*** | (2016.01) |
| *F21Y 115/10* | (2016.01) |

(52) U.S. Cl.
CPC ..... *F21V 19/02* (2013.01); *F21K 9/237* (2016.08); *F21S 8/028* (2013.01); *F21V 11/08* (2013.01); *F21V 17/12* (2013.01); *F21V 17/162* (2013.01); *F21V 23/0471* (2013.01); *F21Y 2115/10* (2016.08)

(58) Field of Classification Search
USPC ..... 362/285, 289, 362, 371, 372
See application file for complete search history.

(56) References Cited

U.S. PATENT DOCUMENTS 2,127,124 A * 8/1938 Litner ..... F21V 17/12 362/448

* cited by examiner

*Primary Examiner* — Vip Patel

(57) ABSTRACT

A light with retractable sleeve comprises a housing, a retractable sleeve disposed inside the housing, and a light body embedded in a front end of the retractable sleeve and protruding out of the housing; the retractable sleeve comprising an inner sleeve, an outer sleeve disposed outside the inner sleeve, and a connector; the inner sleeve having a gear rack; the outer sleeve having thereon a button corresponding to the gear rack; the button being attached on the gear rack via a resilient element to prevent the outer sleeve from undesirably moving out of the inner sleeve along the axial direction; the outer sleeve and the inner sleeve can be extended with each other, so that the outer sleeve is extended out of the housing, thereby facilitating the light body installed thereon, the structure is simple and easy to use.

10 Claims, 10 Drawing Sheets

LIGHT WITH RETRACTABLE SLEEVE

FIELD OF THE INVENTION

The present invention is relates to a light technical field, particularly to a light with retractable sleeve.

BACKGROUND OF THE INVENTION

Light is lighting appliances, the light of the prior art according to installation feature can be divided as follows: table lamps, wall lamps, ceiling lights, floor lamp, and so forth, the light itself according to material can be divided as follows: incandescent, LED, LCD, and so forth, therefore the light is widely used in our daily life.

LED downlight is an improved product that a new design of LED light source is applied on the traditional downlight structure. Compared to the prior art, the LED downlight has following advantages: energy conservation, lower carbon consumption, long service life, good color rendering, fast response speed. The LED downlight is more beautiful and lightweight, which can keep the overall unity of the building decoration and perfection without damaging the light installation; the light source is hidden in the decoration that can avoid glare and has a soft visual effect. However, such traditional LED downlight has certain defects: the LED downlight is usually installed in a reserved hole of the ceiling, and a small sleeve needs to be installed with a small LED light that limits the use of the light, and installation and replacement are difficult.

To overcome the above-mentioned problems, the following invention is provided.

SUMMARY OF INVENTION

Thus, the aim of the present invention is to overcome the above mentioned problems, by providing a light with retractable sleeve.

For solving the above mentioned problems, the technical scheme is provide a light with retractable sleeve, comprising: a housing, a retractable sleeve disposed inside the housing, and a light body embedded in a front end of the retractable sleeve and protruding out of the housing; the retractable sleeve comprising an inner sleeve, an outer sleeve disposed outside the inner sleeve, and a connector disposed at a front end of the outer sleeve for mounting the light body; the outer sleeve performing an axial reciprocating movement in relation to the inner sleeve for extending out or retracting into the housing; the inner sleeve having a gear rack disposed along an axial direction of an outer wall thereof; the outer sleeve having thereon a button corresponding to the gear rack; the button being attached on the gear rack via a resilient element to prevent the outer sleeve from undesirably moving out of the inner sleeve along the axial direction; the retractable sleeve having a socket disposed at the front end thereof, and the light body having a plug compatible with the socket, thereby connecting detachably with each other.

More particularly, wherein the gear rack is composed of a plurality of inverted gear teeth, teeth surface of which is tilted downwardly; the outer sleeve is opened with a mounting position disposed at a lower part thereof for installing the button; the button comprises a button main body having a guiding part formed at a rear end thereof, the button being flexibly installed on the outer sleeve with a spring; the guiding part is engaged with the gear rack, so that the outer sleeve is slidingly sleeved on the inner sleeve; the mounting position has a gap provided for the guiding part passing therethrough and engaging with the gear rack.

More particularly, wherein the inner sleeve comprises a hollow sleeve body and a screw base disposed at one end of the hollow sleeve body, the outer sleeve being a hollow tube structure and sleeved on the inner sleeve; the screw base comprises a contact disposed an end thereof; the inner sleeve comprises a spring disposed therein and a salient point disposed at a front end of the outer wall of the hollow sleeve body; besides, the outer sleeve comprises a flange disposed at a rear end thereof and corresponding to the salient point, such an arrangement between the salient point and the flange can prevent the outer sleeve separation from the front end of the inner sleeve; the inner sleeve has a rear end that extends outward along an edge thereof to prevent the outer sleeve separation from the rear end of the inner sleeve.

More particularly, wherein the housing is a hollow structure and connected with a junction box, and formed into an inner housing disposed at an rear end thereof, the inner housing having an internal thread disposed at an inner wall thereof; the screw base of the inner sleeve is installed in the inner housing, so that the inner sleeve is installed in the housing.

More particularly, wherein the connector comprises a socket holder embedded into the front end of the outer sleeve and the socket, the socket embedded into the socket holder, and socket contacts configured for the light body inserted therein; the socket holder and the outer sleeve, and the socket holder and the socket are fixed with screws.

More particularly, wherein the light body comprises a lower cap, a decorative piece installed on the lower cap, a PC lightshade installed on the decorative piece, and a working assembly installed inside the PC lightshade.

More particularly, wherein the lower cap and the PC shade are formed with a chamber disposed therebetween for receiving the working assembly, the lower cap having a plug disposed at a bottom thereof.

More particularly, wherein the working assembly comprises a LED panel installed in the chamber and disposed under the lower cap, a camera bracket installed in the chamber for installing a camera and extended out of the PC lightshade with one end, the camera bracket having an installing position provided for the camera installed thereon, so that the camera is protruded out of the PC lightshade.

More particularly, wherein the working assembly comprises the LED panel disposed under the lower cap and a human sensor installed on the PC lightshade through a sensor bracket and protruding out therefrom.

More particularly, wherein the working assembly comprises the LED panel installed under the lower cap; LED panel emits light through the PC lightshade.

Compared to prior art, the present invention has the following advantages:

The present invention has the housing installed on the ceiling and retractable sleeve installed in the housing, the inner sleeve and the outer sleeve can be retractable with each other. Thus the outer sleeve is extended out of the housing to facilitate installing, fixing, and replacing the light body. Besides, the light body is capable of be installed with different sizes of the housing, and the retractable sleeve is compatible with different sizes of the light body, so it is very convenient to change the light body according to different needs.

Moreover, The inner sleeve body of the inner sleeve is formed with two corresponding grooves disposed along an axial direction of an outer wall thereof, the outer sleeve is formed with two convex strips corresponding to the grooves, the convex strips and the grooves are joined together to prevent relative rotation between the outer sleeve and the inner sleeve.

Furthermore, the inner sleeve and the outer sleeve of the retractable sleeve are moved stably with each through the gear rack with the button, and the structure is simple and easy to use. The present invention has cancelled the original power line extended into the connector so that the whole structure is safer, and the power line will not cause loose problem when the light body is frequently changed or fixed.

DETAILED DESCRIPTION OF THE PREFERRED EMBODIMENTS

The following embodiments with reference to the drawings of the present invention are further described.

First Embodiment

Figure 1:
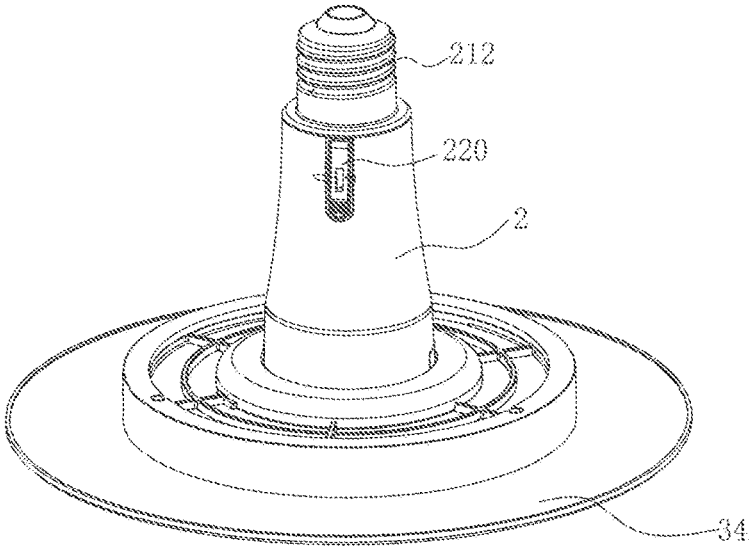
FIG. 1 is a schematic view of a first embodiment of the present invention.
Figure 2:
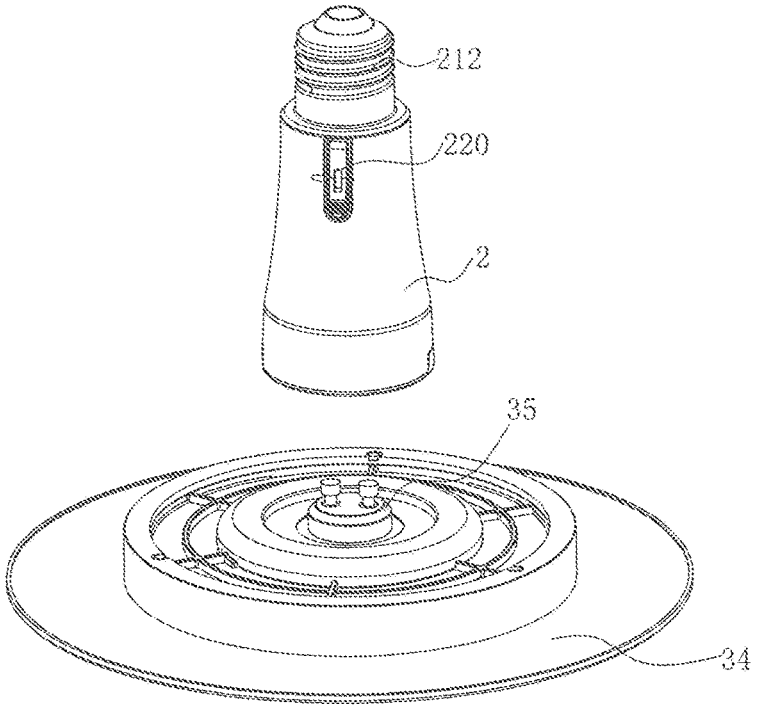
FIG. 2 is an exploded view of the first embodiment.
Figure 3:
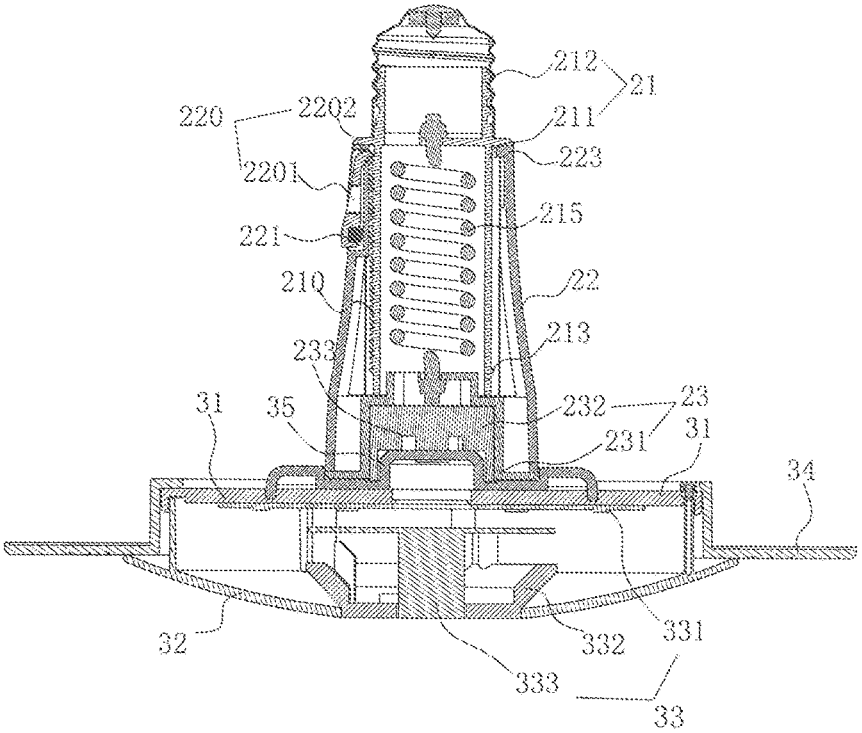
FIG. 3 is a cross-sectional view of the first embodiment.

Referring to FIGS. 1-3, a light with retractable sleeve comprises a housing (1) mounted on a wall or a ceiling, an retractable sleeve (2) disposed inside the housing (1), and a light body (3) embedded in a front end of the retractable sleeve (2) and protruding out from the housing (1).

The retractable sleeve (2) can be extended or retracted into the housing (1) to facilitate the installation of the light body (3); the retractable sleeve (2) comprises an inner sleeve (21), an outer sleeve disposed outside the inner sleeve (21), and a connector (23) disposed at a front end of the outer sleeve (22) for mounting the light body (3). The inner sleeve (21) comprises a hollow sleeve body (211) and a screw base (212) disposed at one end of the hollow sleeve body (211), the outer sleeve (22) is a hollow tube structure, the diameter of which becomes smaller from a front end to a rear end thereof for easy gripping, the outer sleeve (22) is sleeved on the inner sleeve (21). The inner sleeve body (211) of the inner sleeve (21) is formed with two corresponding grooves disposed along an axial direction of an outer wall thereof, the outer sleeve (22) is formed with two convex strips corresponding to the grooves, the convex strips and the grooves are joined together to prevent relative rotation between the outer sleeve (22) and the inner sleeve (21). The inner sleeve (21) comprises a salient point (213) disposed at a front end of the outer wall of the hollow sleeve body (211); besides, the outer sleeve (22) comprises a flange (223) disposed at the rear end thereof and corresponding to the salient point (213), such an arrangement between the salient point (213) and the flange (223) can prevent the outer sleeve (22) separation from the front end of the inner sleeve (21); the salient point (213) is formed with a slope disposed on an upper surface thereof and the flange (223) is also formed with a slope disposed under a bottom surface thereof, so that the inner sleeve (21) can guide the inner sleeve (21) being installed in the outer sleeve (22) from the rear end of the outer sleeve (22) when being assembled; the inner sleeve (21) has a rear end that extends outward along an edge thereof to prevent the outer sleeve (22) separation from the rear end of the inner sleeve (21); the outer sleeve (22) and the cannot removed from the inner sleeve (21) and the outer sleeve (22) cannot be rotated relative to the inner sleeve (21), thereby increasing stability between both sleeves.

The inner sleeve (21) having gear rack (210) disposed along an axial direction of the outer wall thereof, the gear rack (210) being formed on one of the grooves; the outer sleeve (22) having thereon a button (220) corresponding to the gear rack (210), the button (220) being flexibly installed on the outer sleeve (22) through a spring. the gear rack (210) is composed of a plurality of inverted gear teeth, teeth surface of which is tilted downwardly; the button (220) comprises a button main body (2201) having a guiding part (2202) formed at a rear end thereof, the button main body (2201) being integrally formed with a pivot shaft; the outer sleeve (22) is opened with a mounting position (221) disposed at a lower part thereof for installing the button (220), the mounting position (221) having a gap provided for the guiding part (2202) passing therethrough and engaging with the gear rack (210), and a hole provided for the pivot shaft installing therein; the button main body (2201) is connected with the resilient part, the resilient part can be the spring. By spring force, the rear end of the button is engaged with the gear rack (210) under a state of nature; the button (220) comprises skidproof stripes arranged on an upper front surface, and forms a concave space arranged in an inner surface thereof to install on the mounting position (221), which does not affect relative movement between the inner sleeve (21) and the outer sleeve (22). When the retractable sleeve (2) is in a retracting state, the rear end of the outer sleeve (22) is located on the edge of the rear end of the inner sleeve (21); when the retractable sleeve (2) is needed to extend out, press the upper front end of the button (220) to remove the guiding part (2202) of the rear end of the button (220) from the gear rack (210) and then pull the outer sleeve (22) toward the front end of the inner sleeve (21) is required, when the extension is completed, the button (220) is released and recovered to the original position that the guiding part (2202) is engaged on the gear rack (210) by the spring, thereby preventing the outer sleeve (22) independently separated from of the inner sleeve (21).

The housing (1) is a hollow structure and formed with an open disposed at a front end thereof and configured for the retractable sleeve (2) inserted thereinto; the housing (1) is formed into an inner housing at a rear end and connected with a junction box (12); the inner housing comprises a screw thread provided for the screw base (212) threadedly connected therewith, whereby the retractable sleeve (2) is installed inside the housing (1). The screw base (212) of the retractable sleeve (2) is made of metal material.

The connector (23) comprises a socket holder (231) embedded into the front end of the outer sleeve (22), a socket (232) installed inside the socket holder (231), and socket contacts (233) configured for the light body inserted therein;

the socket holder (231) and the outer sleeve (22), and the socket holder (231) and the socket (232) are fixed with screws; the socket contacts are disposed correspondingly that are composed of an installing aperture and a turning groove, a connecting part between the installing aperture and the turning groove being formed with a limiting protrude point.

The outer sleeve (22) is formed with concave parts disposed at one end for joining with corresponding convex parts formed under a bottom surface of the socket holder (231), thereby not only fixing the socket (231) and the outer sleeve (22) together, but also reminding the correct assembly between the socket (231) and the outer sleeve (22).

The light body (3) comprises a lower cap (31), a decorative piece (34) installed on the lower cap (31), a PC lightshade (32) installed on the decorative piece (34), and a working assembly (33) installed inside the PC lightshade (32). The lower cap (31) and the PC shade (32) are formed with a chamber disposed therebetween for receiving the working assembly (33), the lower cap (31) having a plug (35) disposed at a bottom thereof. The working assembly (33) comprises a LED panel (331) installed in the chamber and disposed under the lower cap (31), a camera bracket (332) installed in the chamber for installing a camera (333); the camera bracket (332) extends out of the PC lightshade (32) with one end, so that the camera (333) is protruded out of the PC lightshade (32).

Figure 4:
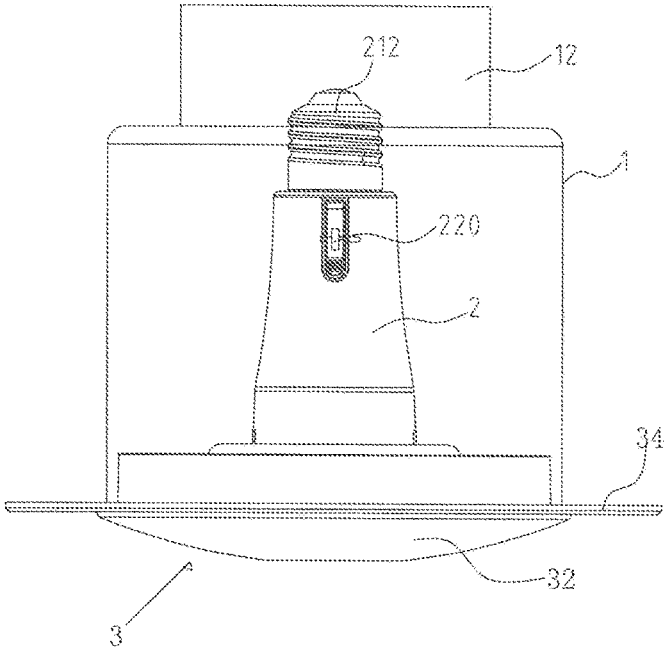
FIG. 4 is a schematic view showing a small size of a housing combined with the first embodiment.
Figure 5:
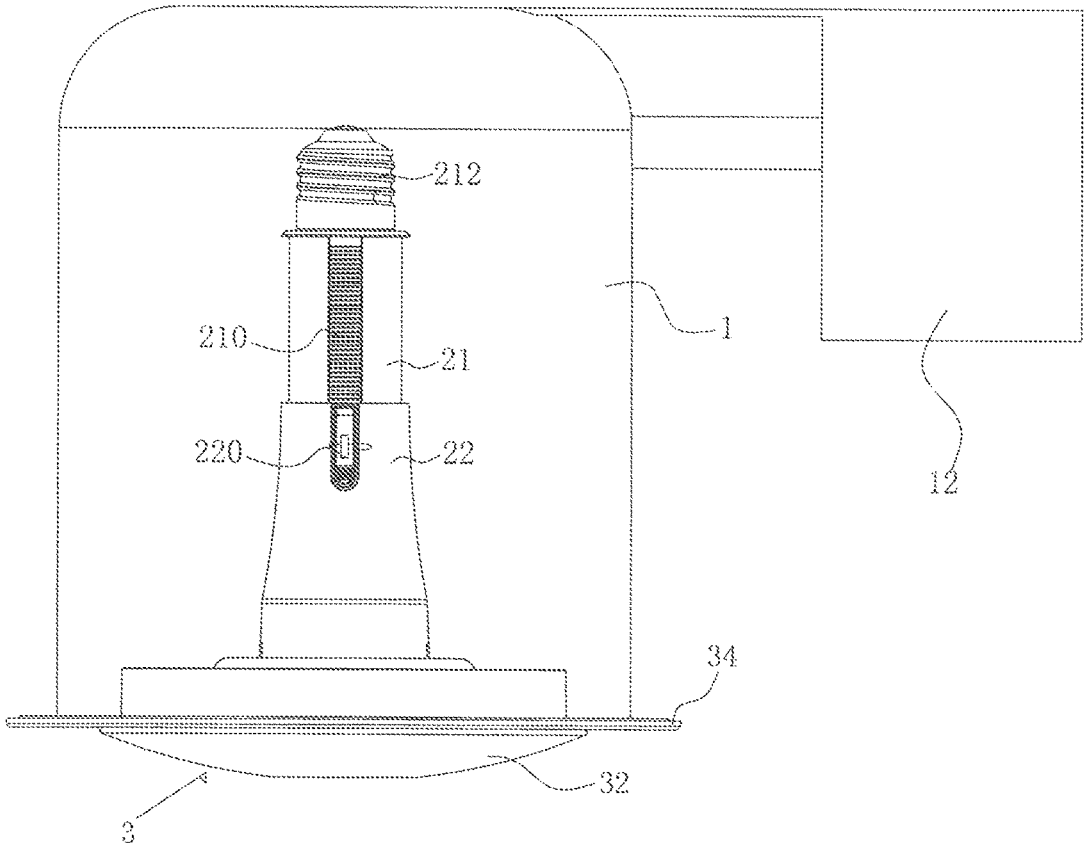
FIG. 5 is a schematic view showing a big size of the housing combined with the first embodiment.

The light body (3) and the retractable sleeve (2) are detachably connected by the socket (232) and the plug (35), wherein the socket (232) is a GU10 female socket and the plug (35) is a corresponding GU10 male plug, whereby the retractable sleeve (2) can be connected to the light body (3) with different functions. The retractable sleeve (2) is allowed to be connected with different sizes of the housing (1), the FIG. 4 shows that the retractable sleeve (2) is in a retracted state, which is connected with a small size of the housing (1); the FIG. 5 shows that the retractable sleeve (2) is in an extended state, which is connected with a big size of the housing (1), thereby meeting demands of different sizes and providing easy installation. The working assembly (33) of the embodiment comprises the LED panel (331) and the camera (333), which not only has a lighting function, but also has a monitor function, so the invention is more widely used.

Second Embodiment

Figure 6:
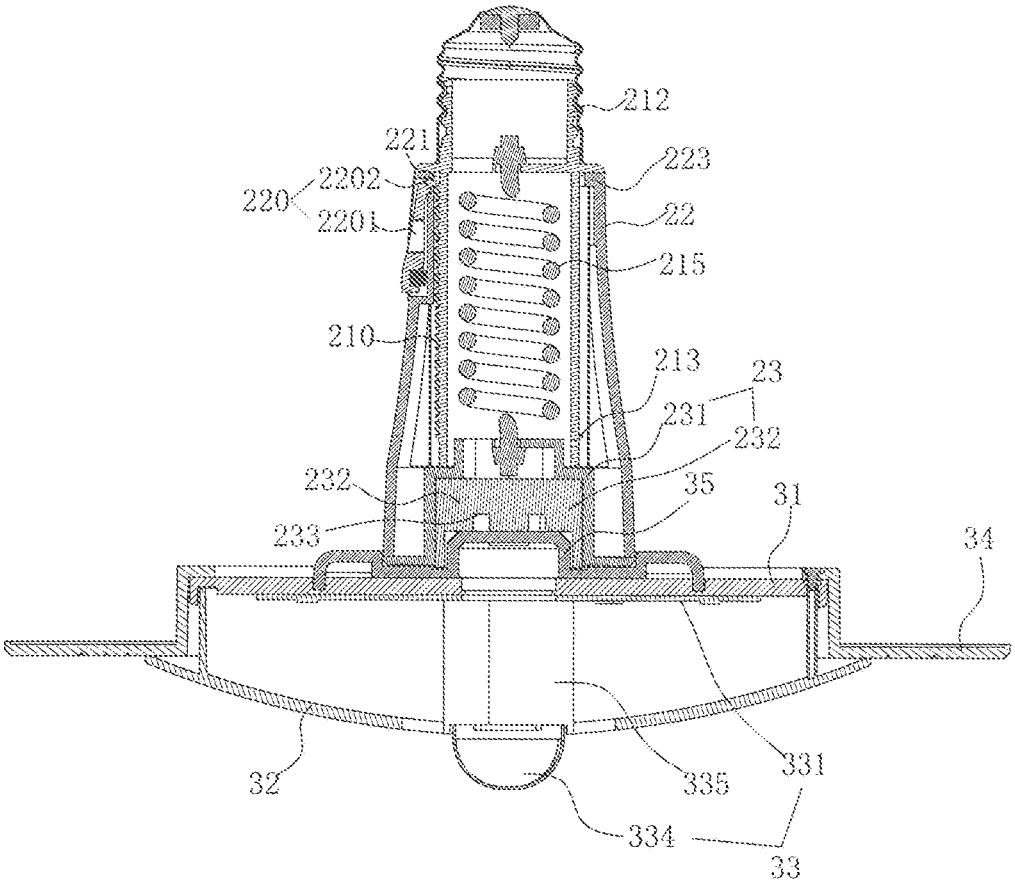
FIG. 6 is a cross-sectional view of a second embodiment.

Referring to FIG. 6, the second embodiment is differed from the first embodiment is that the working assembly (33) the working assembly (33) comprises a human sensor (334) installed in the chamber and disposed under the lower cap (31), a sensor bracket (335) installed in the chamber for installing a camera (333); the sensor bracket (335) extends out of the PC lightshade (32) with one end, so that the human sensor (334) is protruded out of the PC lightshade (32). the light body (2) of the second embodiment has both lighting and sensing functions; the human sensor is capable of automatically turning on the LED light when detecting a person walking in an lighting area, and then turning off when the person is out of the lighting area, thereby saving more power.

Figure 7:
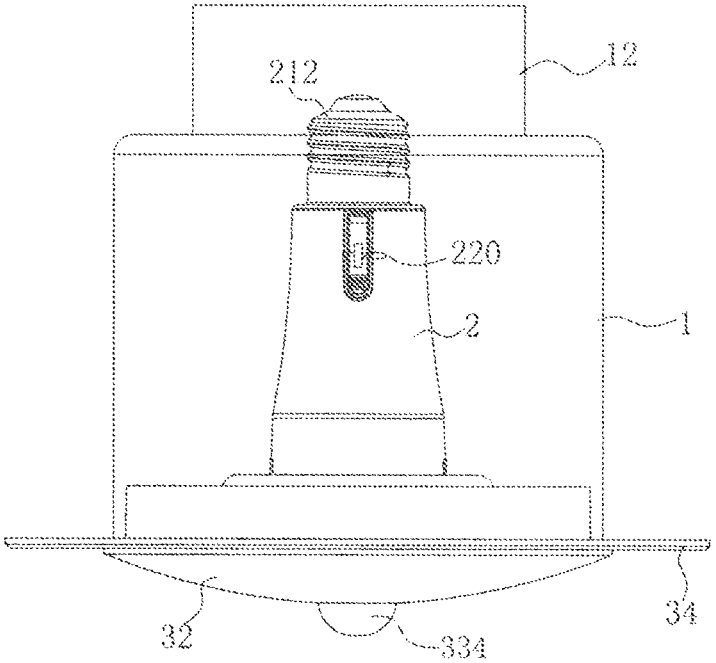
FIG. 7 is a schematic view showing the small size of the housing combined with the second embodiment.
Figure 8:
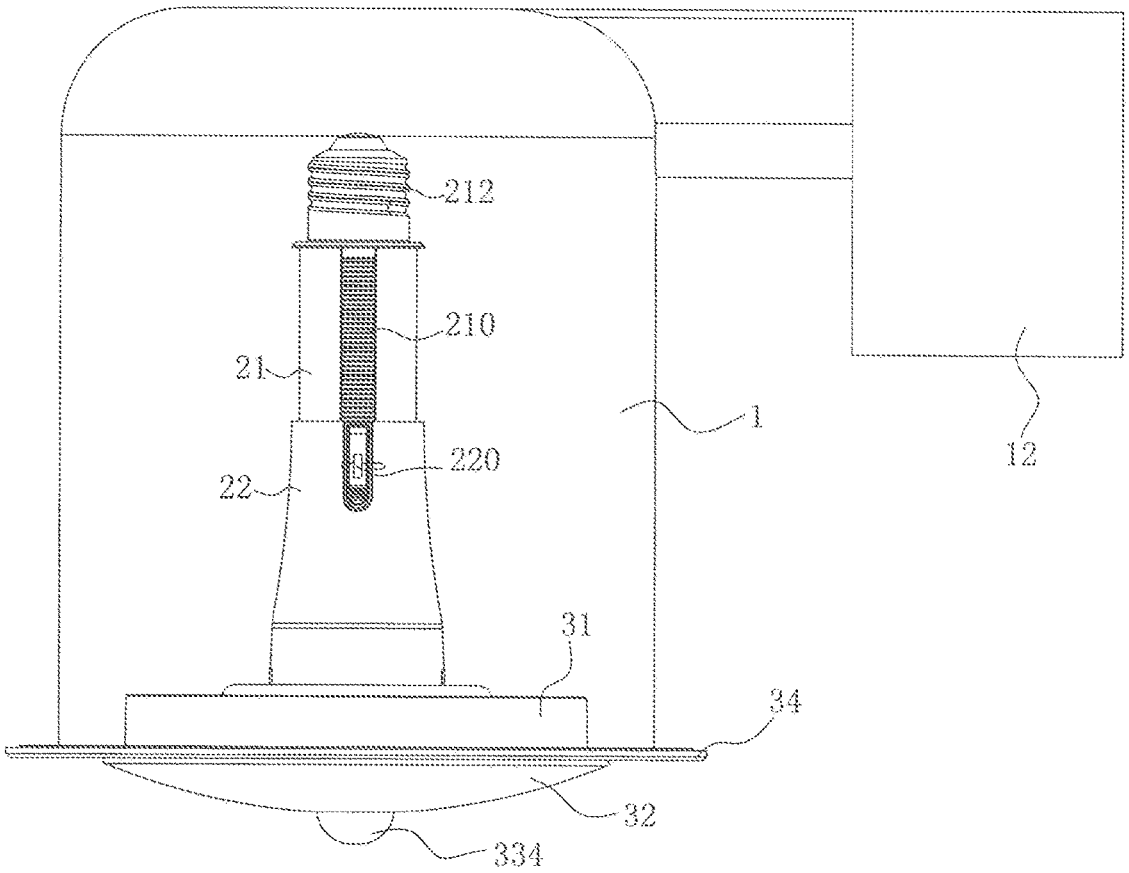
FIG. 8 is a schematic view showing the big size of the housing combined with the second embodiment.

Simultaneously, the retractable sleeve (2) is allowed to be connected with different sizes of the housing (1), the FIG. 7 shows that the retractable sleeve (2) is in a retracted state, which is connected with a small size of the housing (1); the FIG. 8 shows that the retractable sleeve (2) is in an extended state, which is connected with a big size of the housing (1), thereby meeting demands of different sizes and providing easy installation.

Third Embodiment

Figure 9:
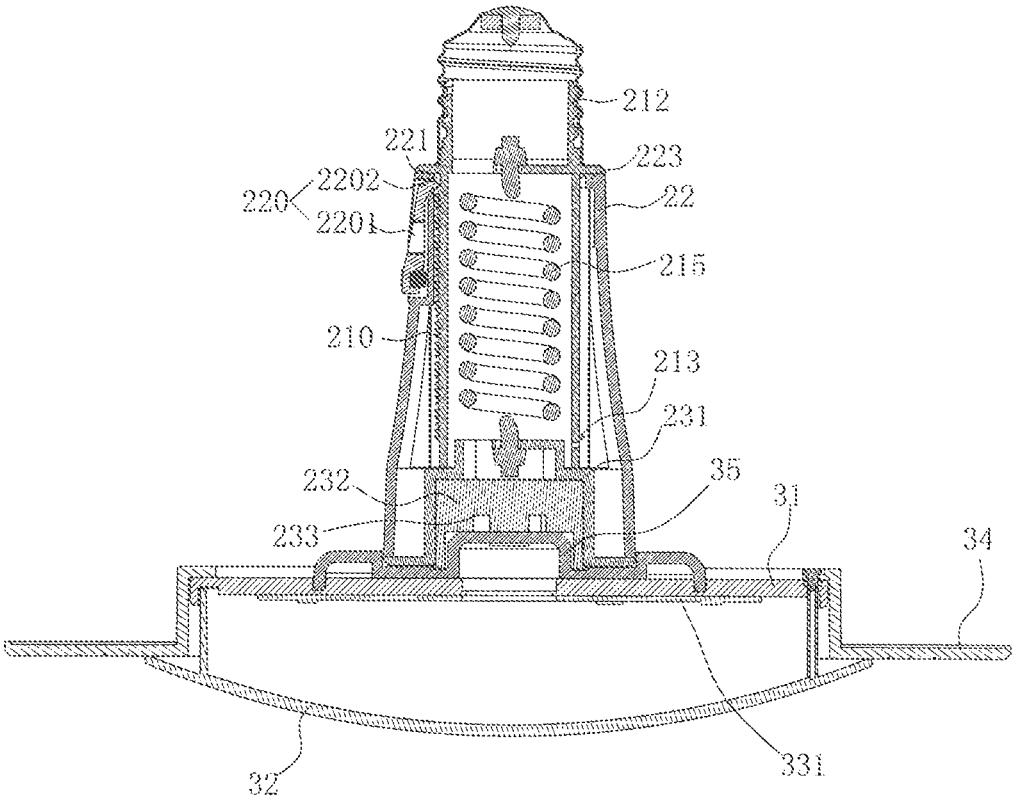
FIG. 9 is a cross-sectional view of a third embodiment.

Referring to FIG. 9, the third embodiment is differed from the second embodiment is that the working assembly (33) the working assembly (33) comprises the LED panel (331) installed under the lower cap (31), wherein the LED panel (331) lights through the PC lightshade (32). The working assembly of the working assembly is just used for lighting function.

Figure 10:
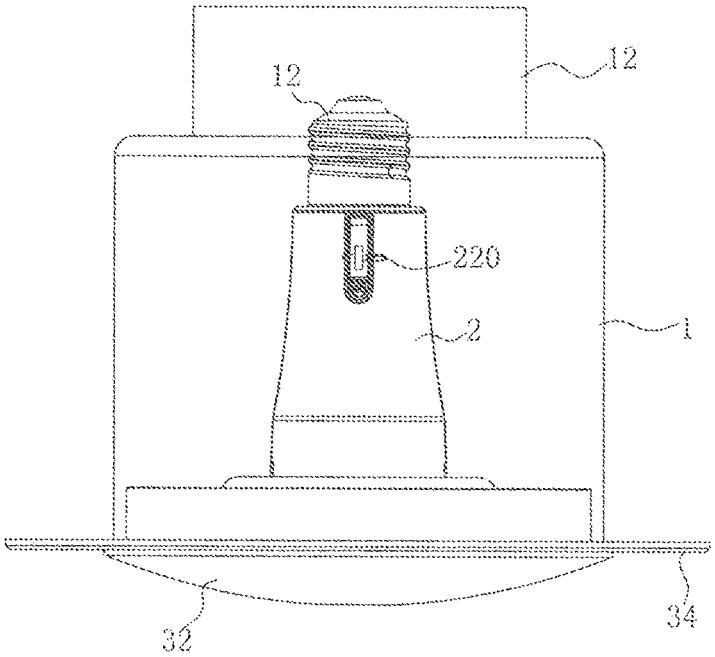
FIG. 10 is a schematic view showing the small size of the housing combined with the third embodiment.
Figure 11:
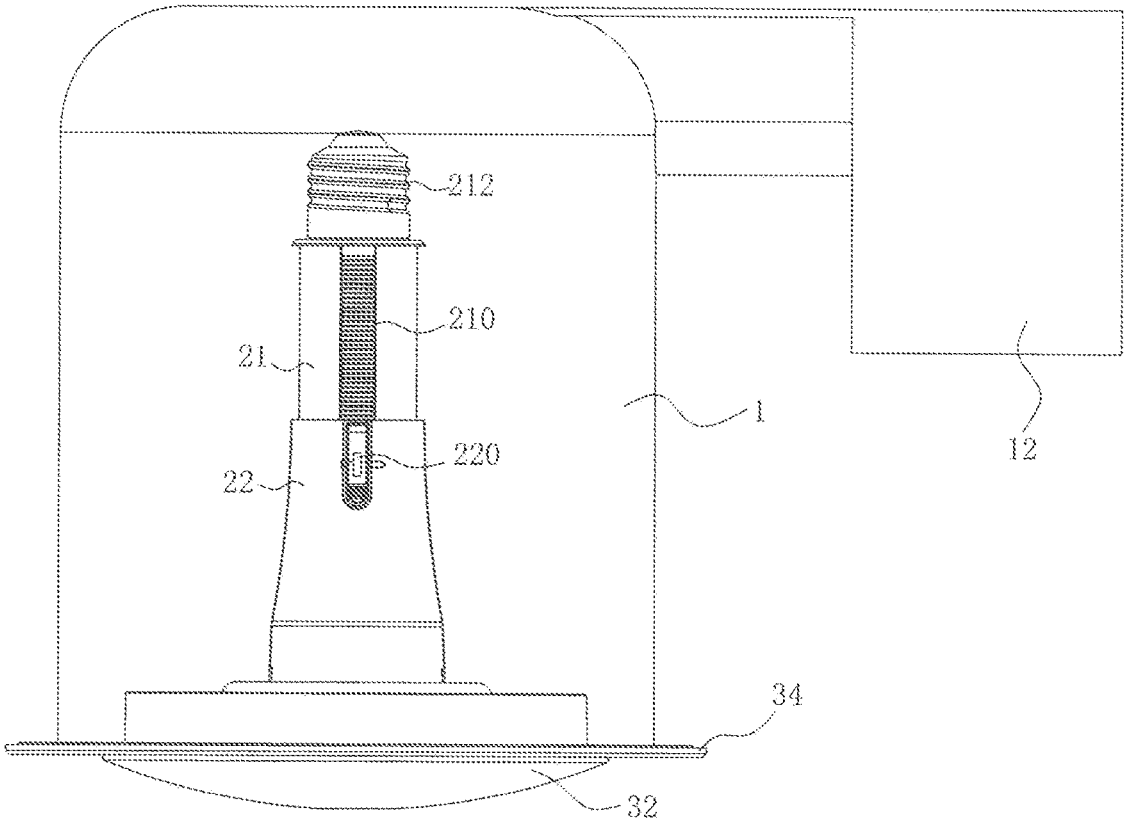
FIG. 11 is a schematic view showing the big size of the housing combined with the third embodiment.
Figure 12:
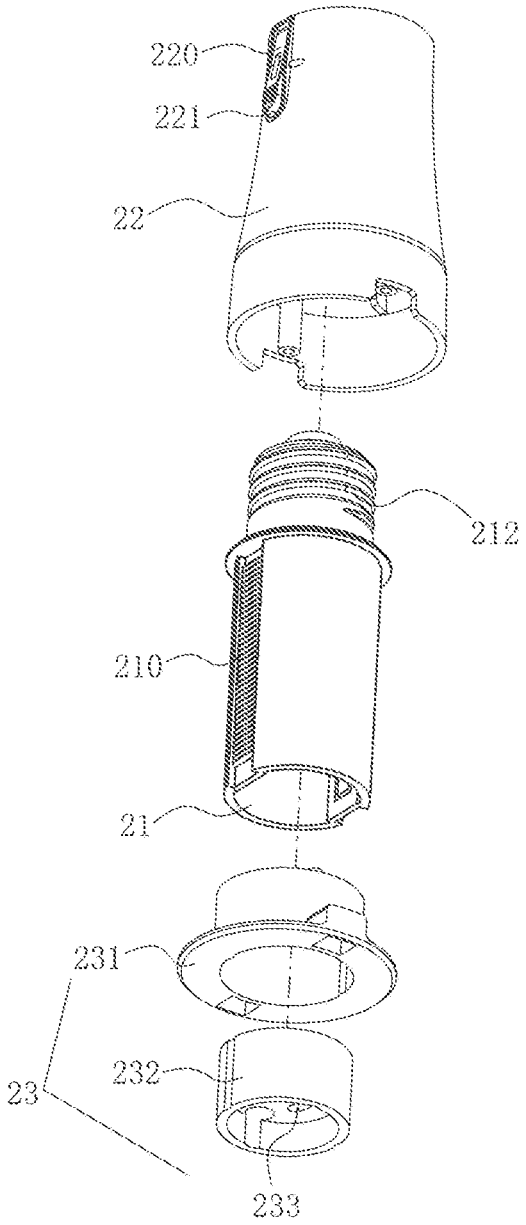
FIG. 12 is an exploded view of the retracted sleeve of the present invention.

Simultaneously, the retractable sleeve (2) is allowed to be connected with different sizes of the housing (1), the FIG. 10 shows that the retractable sleeve (2) is in a retracted state, which is connected with a small size of the housing (1); the FIG. 11 shows that the retractable sleeve (2) is in an extended state, which is connected with a big size of the housing (1), thereby meeting demands of different sizes and providing easy installation.

The retractable sleeve of the present invention not only can be connected with different sizes of the housing, but also can be connected with different functions of the light body, such as an infrared light with automatic sensor, a light with voice control function, the major difference is the function of the light body, but connection between the light body and the retractable sleeve is the same as the embodiments.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A light with retractable sleeve, comprising:

a housing (1), a retractable sleeve (2) disposed inside the housing (1), and a light body (3) embedded in a front end of the retractable sleeve (2) and protruding out of the housing (1);

the retractable sleeve (2) comprising an inner sleeve (21), an outer sleeve (22) disposed outside the inner sleeve (21), and a connector (23) disposed at a front end of the outer sleeve (22) for mounting the light body (3); the outer sleeve (22) performing an axial reciprocating movement in relation to the inner sleeve (21) for extending out or retracting into the housing (1); the inner sleeve (21) having a gear rack (210) disposed along an axial direction of an outer wall thereof; the outer sleeve (22) having thereon a button (220) corresponding to the gear rack (210); the button (220) being attached on the gear rack (210) via a resilient element to prevent the outer sleeve (22) from undesirably moving out of the inner sleeve (21) along the axial direction; the retractable sleeve (2) having a socket (232) disposed at the front end thereof, and the light body (3) having a plug (35) compatible with the socket (232), thereby connecting detachably with each other.

2. The light with retractable sleeve according to claim 1, wherein the gear rack (210) is composed of a plurality of inverted gear teeth, teeth surface of which is tilted downwardly; the outer sleeve (22) is opened with a mounting position (221) disposed at a lower part thereof for installing the button (220); the button (220) comprises a button main body (2201) having a guiding part (2202) formed at a rear end thereof, the button (220) being flexibly installed on the outer sleeve (220) with a spring; the guiding part (2202) is engaged with the gear rack (210), so that the outer sleeve (22) is slidingly sleeved on the inner sleeve (21); the mounting position (221) has a gap provided for the guiding part (2202) passing therethrough and engaging with the gear rack (210).

3. The light with retractable sleeve according to claim 1, wherein the inner sleeve (21) comprises a hollow sleeve body (211) and a screw base (212) disposed at one end of the hollow sleeve body (211), the outer sleeve (22) being a hollow tube structure and sleeved on the inner sleeve (21); the screw base (212) comprises a contact disposed an end thereof; the inner sleeve (21) comprises a spring (215) disposed therein and a salient point (213) disposed at a front end of the outer wall of the hollow sleeve body (211); besides, the outer sleeve (22) comprises a flange (223) disposed at a rear end thereof and corresponding to the salient point (213), such an arrangement between the salient point (213) and the flange (223) can prevent the outer sleeve (22) separation from the front end of the inner sleeve (21); the inner sleeve (21) has a rear end that extends outward along an edge thereof to prevent the outer sleeve (22) separation from the rear end of the inner sleeve (21).

4. The light with retractable sleeve according to claim 1, wherein the housing (1) is a hollow structure and connected with a junction box (12), and formed into an inner housing disposed at an rear end thereof, the inner housing having an internal thread disposed at an inner wall thereof; the screw base (212) of the inner sleeve (21) is installed in the inner housing, so that the inner sleeve (21) is installed in the housing (1).

5. The light with retractable sleeve according to claim 1, wherein the connector (23) comprises a socket holder (231) embedded into the front end of the outer sleeve (22) and the socket (232), the socket (232) embedded into the socket holder (231), and socket contacts (233) configured for the light body (3) inserted therein; the socket holder (231) and the outer sleeve (22), and the socket holder (231) and the socket (232) are fixed with screws.

6. The light with retractable sleeve according to claim 1, wherein the light body (3) comprises a lower cap (31), a decorative piece (34) installed on the lower cap (31), a PC lightshade (32) installed on the decorative piece (34), and a working assembly (33) installed inside the PC lightshade (32).

7. The light with retractable sleeve according to claim 6, wherein the lower cap (31) and the PC shade (32) are formed with a chamber disposed therebetween for receiving the working assembly (33), the lower cap (31) having a plug (35) disposed at a bottom thereof.

8. The light with retractable sleeve according to claim 7, wherein the working assembly (33) comprises a LED panel (331) installed in the chamber and disposed under the lower cap (31), a camera bracket (332) installed in the chamber for installing a camera and extended out of the PC lightshade (32) with one end, the camera bracket having an installing position provided for the camera (333) installed thereon, so that the camera (333) is protruded out of the PC lightshade (32).

9. The light with retractable sleeve according to claim 7, wherein the working assembly (33) comprises the LED panel (331) disposed under the lower cap (31) and a human sensor (334) installed on the PC lightshade (32) through a sensor bracket (335) and protruding out therefrom.

10. The light with retractable sleeve according to claim 7, wherein the working assembly (33) comprises the LED panel (331) installed under the lower cap (31); LED panel (331) emits light through the PC lightshade (32).

* * * * *